US007080601B2

(12) United States Patent
Hayashi et al.

(10) Patent No.: US 7,080,601 B2
(45) Date of Patent: Jul. 25, 2006

(54) YARN FEEDER

(75) Inventors: Hideyuki Hayashi, Nabari (JP); Kei Chizuka, Tondabayashi (JP); Kenji Michishita, Habikino (JP)

(73) Assignees: Hideyuki Hayashi, Mie (JP); Kenji Michishita, Osaka (JP)

( * ) Notice: Subject to any disclaimer, the term of this patent is extended or adjusted under 35 U.S.C. 154(b) by 0 days.

(21) Appl. No.: 10/895,373

(22) Filed: Jul. 21, 2004

(65) Prior Publication Data

US 2005/0132944 A1 Jun. 23, 2005

(30) Foreign Application Priority Data

Dec. 17, 2003 (JP) ..... 2003-419098

(51) Int. Cl.
*D05C 15/18* (2006.01)

(52) U.S. Cl. ..... 112/80.73

(58) Field of Classification Search ..... 112/80.01, 112/80.24, 80.54, 80.07, 80.73; 242/151, 242/155 R, 149, 419.5, 419.4, 154
See application file for complete search history.

(56) References Cited

U.S. PATENT DOCUMENTS 2,320,264 A * 5/1943 Chapman, Sr. ..... 242/155 R
4,106,712 A * 8/1978 Savio et al. ..... 242/419.7
4,856,441 A * 8/1989 Kurata ..... 112/80.73
5,738,295 A * 4/1998 Flamm et al. ..... 242/419.1
6,009,818 A * 1/2000 Card et al. ..... 112/80.73

FOREIGN PATENT DOCUMENTS

| | | |
|---|---|---|
| JP | 61-19856 | 1/1986 |
| JP | 1-43424 | 12/1989 |
| JP | 2-466 | 1/1990 |

* cited by examiner

*Primary Examiner*—Danny Worrell
(74) *Attorney, Agent, or Firm*—Wenderoth, Lind & Ponack, L.L.P.

(57) ABSTRACT

A yarn feeder for a tufting machine is compact and simple in structure and is still capable of freely changing the heights of piles formed by each pile yarn on a fabric. The yarn feeder includes yarn feed rolls for feeding pile yarns to a row of needles of the tufting machine, and a brake device provided between the feed rolls and the needles. The brake device includes a grooved plate having grooves arranged in the width direction of the grooved plate and each receiving one of the pile yarns that are being fed from the feed rolls to the needles, and presser members each opposing one of the grooves. The presser members are movable toward and away from the respective grooves independently of one another. By pressing selected one or ones of the presser members against the bottoms of the corresponding grooves with yarns sandwiched therebetween, the feed rates of the yarns can be freely changed independently of one another without unduly increasing the size of the yarn feeder or complicating its structure.

4 Claims, 6 Drawing Sheets

YARN FEEDER

BACKGROUND OF THE INVENTION

This invention relates to a yarn feeder for use with a tufting machine.

Such a yarn feeder typically includes feed rolls for supplying pile yarns at predetermined speeds to respective needles of the tufting machine, which are aligned in the width direction of a fabric which is being fed through the tufting machine and on which pile yarns are to be stitched. By individually controlling the feed rates of the yarns, the lengths of piles formed by the respective pile yarns can be changed individually, so that tufted carpets having different pile patterns can be produced.

Such yarn feeders are disclosed in various prior art documents. For example, JP patent publication 61-19856 (unexamined) discloses a yarn feeder in which the feed rate of each pile yarn is controlled by changing the rotational speed of the corresponding feed roll in a plurality of stages. In order to change the rotational speed of the corresponding feed roll in a plurality of stages, a transmission must be provided between the respective feed roll and its drive unit.

The yarn feeder disclosed in JP patent publication 2-466 (examined) includes a plurality of roller sets. Each set comprises a plurality of feed rolls that are rotating at different speeds from each other, and idle rolls each opposing one of the feed rolls. Each pile yarn is passed between the feed rolls and idle rolls of one roller set. By selectively pressing only one of the idle rolls against the corresponding feed roll, the pile yarn can be fed at a speed corresponding to the rotating speed of any desired one of the feed rolls. In order to rotate the plurality of feed rolls at different speeds, they have to be individually driven by separate drive units. That is, it is necessary to provide as many drive units as the feed rolls.

For the above reasons, the yarn feeders disclosed in these prior publications are complicated in structure and expensive.

The yarn feeder disclosed in JP utility model publication 1-43424 includes a plurality of plate members elongated in the direction in which the needles of the tufting machine are aligned and formed with a plurality of holes in which are passed respective pile yarns. By moving the plate members in the direction perpendicular to the direction in which the needles are aligned, it is possible to change the feed lengths and thus the feed rates of the respective pile yarns. Compared to the yarn feeders disclosed in the first two publications, this yarn feeder is less complicated in structure. But in order to change the feed rate of each pile yarn to a meaningful extent, the plate members have to be moved or swung a rather long distance in the direction perpendicular to the direction in which the needles are aligned. This of course requires a large space in which the plate members can swing, which in turn increases the size of the yarn feeder and thus the entire tufting machine. Moreover, pile yarns passed through holes formed in any particular plate member cannot be pulled out of this particular plate member and inserted into another plate member while the tufting machine is in operation. This limits variation of pile patterns that can be formed on each tufted carpet, compared to variation of pile patterns that can be produced by the yarn feeders disclosed in the first two publications.

An object of the invention is to provide a yarn feeder for a tufting machine which is compact and simple in structure and is still capable of freely changing the heights of piles formed by each pile yarn on a fabric.

SUMMARY OF THE INVENTION

According to the present invention, there is provided a yarn feeder for a tufting machine having needles aligned in a width direction of a fabric to be formed into a tufted product in the tufting machine, the yarn feeder comprising yarn feed rolls for feeding a plurality of rows of pile yarns to the respective needles at a predetermined feed speed, and a brake device for individually and selectively applying braking force to the respective pile yarns while the yarns are being fed from the feed rolls to the needles.

By individually applying braking force to selected pile yarns, the feed rates of the yarns can be freely changed without increasing the size or complicating the structure of the yarn feeder.

The brake device preferably comprises a grooved member formed with a plurality of grooves each for receiving one of the pile yarns, and a plurality of presser members which are individually movable toward the respective grooves until pressed against the bottoms with the pile yarns sandwiched between the presser members and the bottoms of the grooves, and movable away from the bottoms. Such a brake device is simpler in structure.

More preferably, the brake device comprises a plurality of brake units arranged in the feed direction of the pile yarns between the feed rolls and the needles, each of the brake units comprising a grooved member formed with a plurality of grooves each for receiving one of part of the pile yarns that are not fed through the other brake unit, and a plurality of presser members which are individually movable toward the bottoms of the respective grooves until pressed against the bottoms with the pile yarns sandwiched between the presser members and the bottoms of the grooves, and movable away from the bottoms. With this arrangement, pile yarns can be separately fed to the plurality of brake units which are arranged in the feed direction of the yarns. This minimizes the width of the yarn feeder and thus the entire tufting machine.

More preferably, the grooved member is a grooved roll which can be rotated at a variable speed and formed with a plurality of annular grooves formed in the outer peripheral surface the grooved roll, and the plurality of presser members are rotatably supported disks each having its outer edge received in one of the annular grooves so as to be individually pressed against the bottoms of the annular grooves with the pile yarns sandwiched therebetween. With this arrangement, by changing the rotational speed of the grooved roll, the feed rate of each yarn can be changed infinitely while the yarn is being braked. Thus, pile heights can be changed infinitely, which of course greatly increases the variation of pile patterns.

When braking force is applied to a yarn, the yarn would sag between the brake device and the feed roll and tend to tangle with other yarns if there were no means for preventing sagging of yarns. Thus, in order to prevent yarns from sagging when braking force is applied to them, a tensioner is provided between the yarn feed rolls and the brake device for tensioning any pile yarn to which braking force is being applied by the brake device.

BRIEF DESCRIPTION OF THE DRAWINGS

Other features and objects of the present invention will become apparent from the following references and the accompanying drawings, in which.

DETAILED DESCRIPTION OF THE PREFERRED EMBODIMENT

Figure 1:
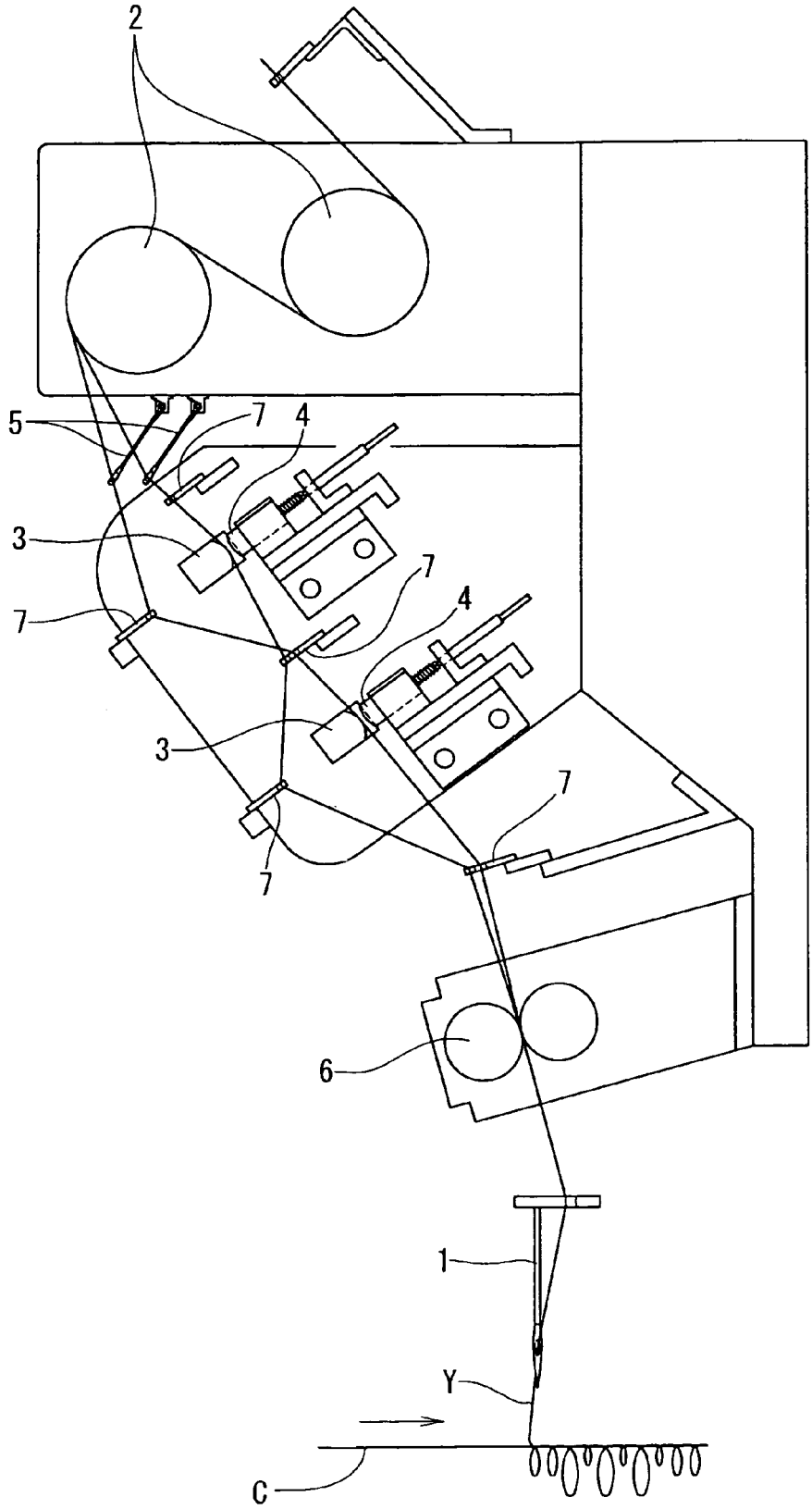
FIG. 1 is a schematic side view of a tufting machine including a yarn feeder according to a first embodiment of the present invention.
Figure 2:
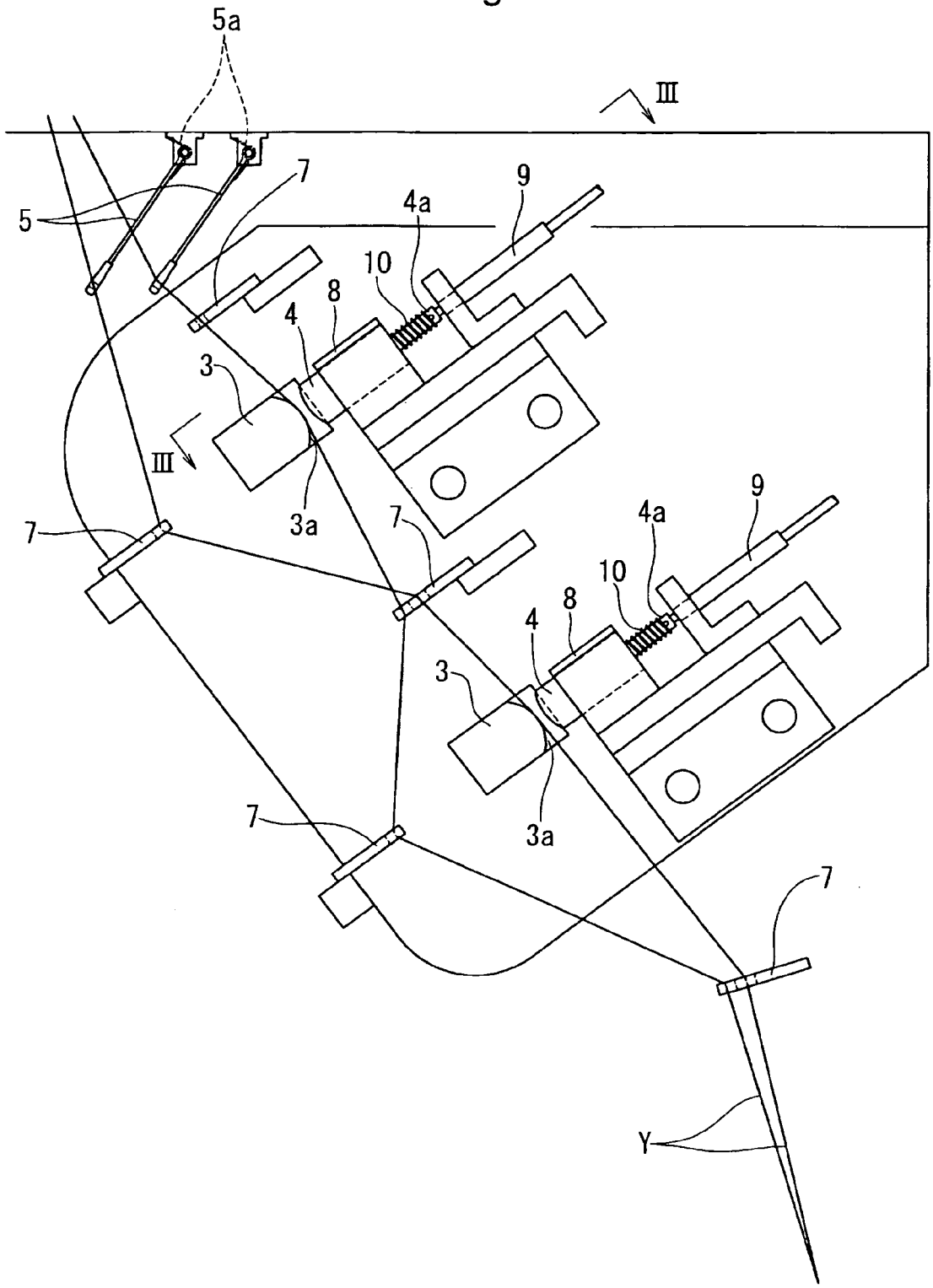
FIG. 2 is an enlarged view of a portion of FIG. 1.
Figure 3:
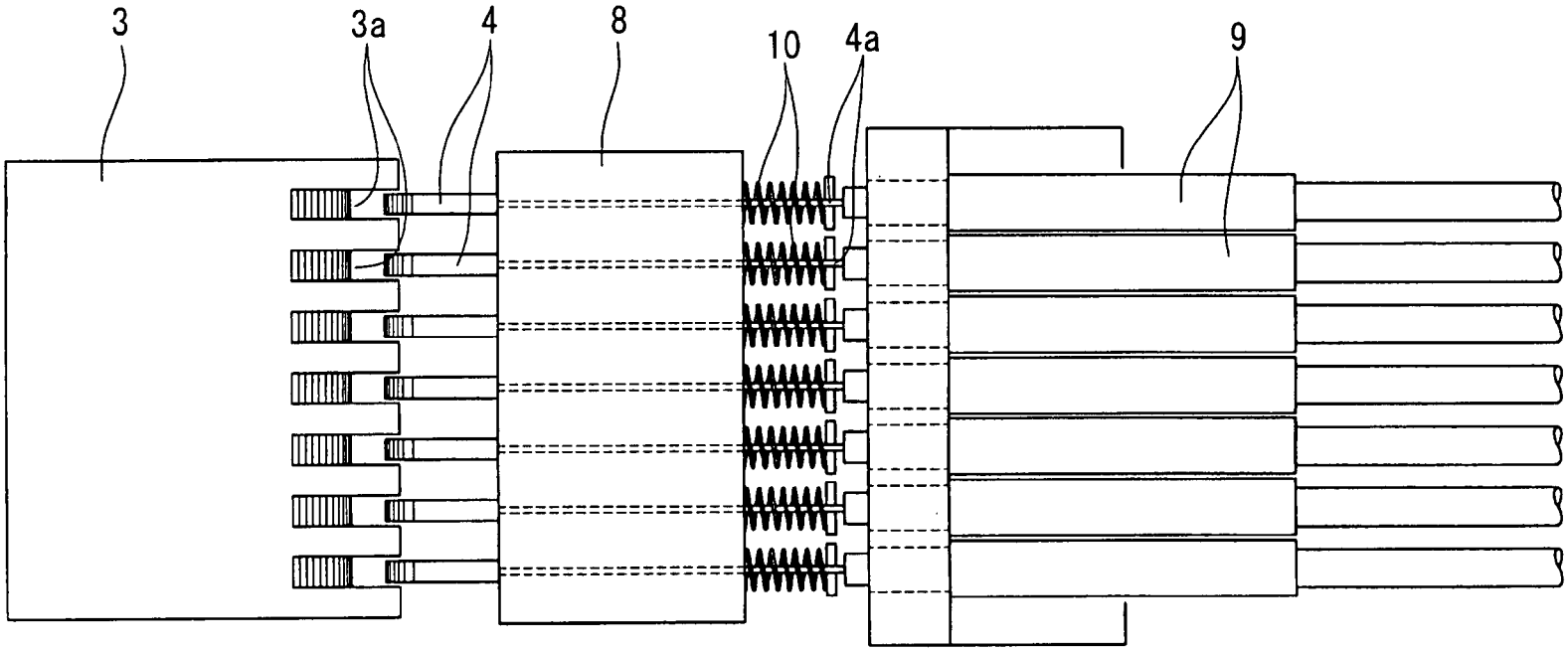
FIG. 3 is an enlarged view of the yarn feeder of FIG. 1, as viewed in the direction of the arrows III of FIG. 2.

Referring now to FIGS. 1–4, the yarn feeder for use in a tufting machine according to the first embodiment of the present invention includes feed rolls 2 (FIG. 1) for feeding pile yarns Y at a predetermined speed to respective needles 1 of the tufting machine that are aligned in the width direction of a fabric C to be formed into a tufted carpet. While being fed between the feed rolls 2 and the needles 1, the pile yarns Y pass through a brake means which can individually apply braking force to the respective yarns. As shown in FIGS. 2 and 3, the brake means comprises two brake units each comprising a plate member 3 having parallel grooves 3*a* formed in the top surface thereof at equal intervals in the width direction thereof, and a plurality of presser members 4 which can be inserted into the respective grooves 3*a*. Between the feed rolls 2 and each of the brake units, each yarn Y is engaged by a swing arm 5 biased by a torsion coil spring 5*a* in a direction to apply tension to the yarn so as to keep the yarn tensioned even when the braking force is increased and the feed speed of the yarn is slowed down between the brake means and the corresponding needle. Between each of the brake units and the needles, each yarn passes between puller rollers 6 for keeping the yarn tensioned.

As shown in FIG. 2, one of the brake units is provided downstream of the other brake unit with respect to the feed direction of the yarns Y. Alternate yarns pass through the grooves 3*a* formed in the plate member 3 of one of the brake units, and the remaining alternate yarns pass through the grooves 3*a* formed in the plate member 3 of the other brake unit. While not shown, each groove 3*a* of the upstream plate member 3 is displaced by a half pitch in the width direction from the corresponding groove 3*a* of the downstream plate member 3. Upstream and downstream of each brake unit, yarn guides 7 are provided. While only two swing arms 5 are shown in FIG. 2, a plurality of them are aligned in the direction in which the needles 1 are aligned. The grooves 3*a* have their bottoms arcuately convexed as viewed from the width direction of the plate members 3 and satin-finished to impart greater contact resistance to the yarns.

The presser members 4 are aligned in the width direction of the plate members 3 and have their front ends, which are adapted to be inserted into the respective grooves 3*a* of the plate members 3, arcuately convexed. The presser members 4 are guided by a guide member 8 so as to be movable toward and away from the respective grooves 3*a* of the plate members 3, and are individually coupled to air cylinders 9 through respective support rods 4*a*. As shown in FIG. 3, a compression coil spring 10 is mounted around each support rod 4*a* and has one end thereof in engagement with a pin fixed to the rod 4*a* and the other end in engagement with the rear end of the guide member 8, thereby biasing the rod 4*a* and thus the presser member 4 away from the respective groove 3*a*. When any of the air cylinders 9 is activated, the corresponding presser member 4 is pushed into the corresponding groove 3*a* of the plate member 3, thereby pressing the yarn Y in this groove 3*a* against the bottom of the groove. The yarn is thus braked. Thus, by selectively activating one, some or all of the air cylinders 9, braking force can be applied to any desired yarn or yarns. When the air cylinder is deactivated, the presser member 4 retracts by the force of the coil spring 10, releasing the yarn Y.

Figure 4A:
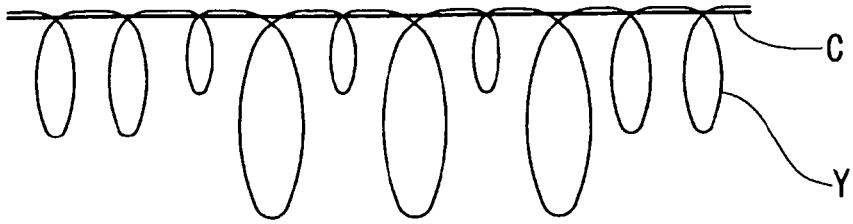
FIGS. 4A–4C show piling patterns formed by a single yarn in the tufting machine of FIG. 1.
Figure 4B:
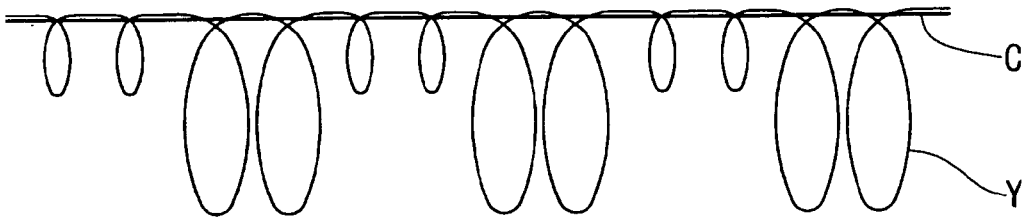
Figure 4C:
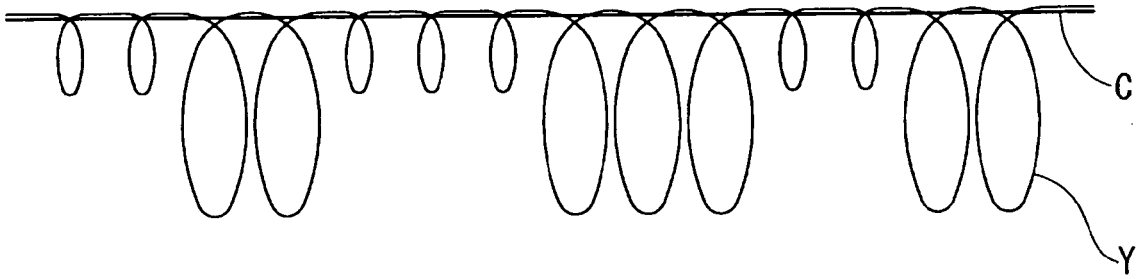

FIGS. 4A–4C show piling patterns formed by a single pile yarn. In these figures, high piles, low piles and medium-height piles are shown. Each pile is formed by one stroke of the needle. Braking force is repeatedly applied to the yarn at the beginning (or end) of any predetermined stroke of the needle and released at the beginning of any subsequent stroke of the needle. Low piles are formed as long as the braking force is being applied to the yarn. When the braking force is released thereafter, as many piles as the low piles formed immediately before the brake has been released are formed. Thereafter, as long as the braking force is not applied, medium-height piles are formed.

Specifically, FIG. 4A shows a pile pattern formed by alternately applying and releasing braking force at the beginning of every stroke of the needle, except the two piles at either end of the pattern. FIG. 4B shows a pile pattern formed by alternately applying and releasing the brake at the end of every other stroke of the needle. FIG. 4C shows a pile pattern formed by alternately applying and releasing the brake alternately at the beginning of every second and every third stroke of the needle. Of course, an infinite number of other combinations of low piles, high piles and medium-height piles can be designed.

Instead of the arcuately convexed surfaces, different curved and/or flat surfaces may be employed to sandwich yarns as long as such surfaces can smoothly guide yarns.

Figure 5:
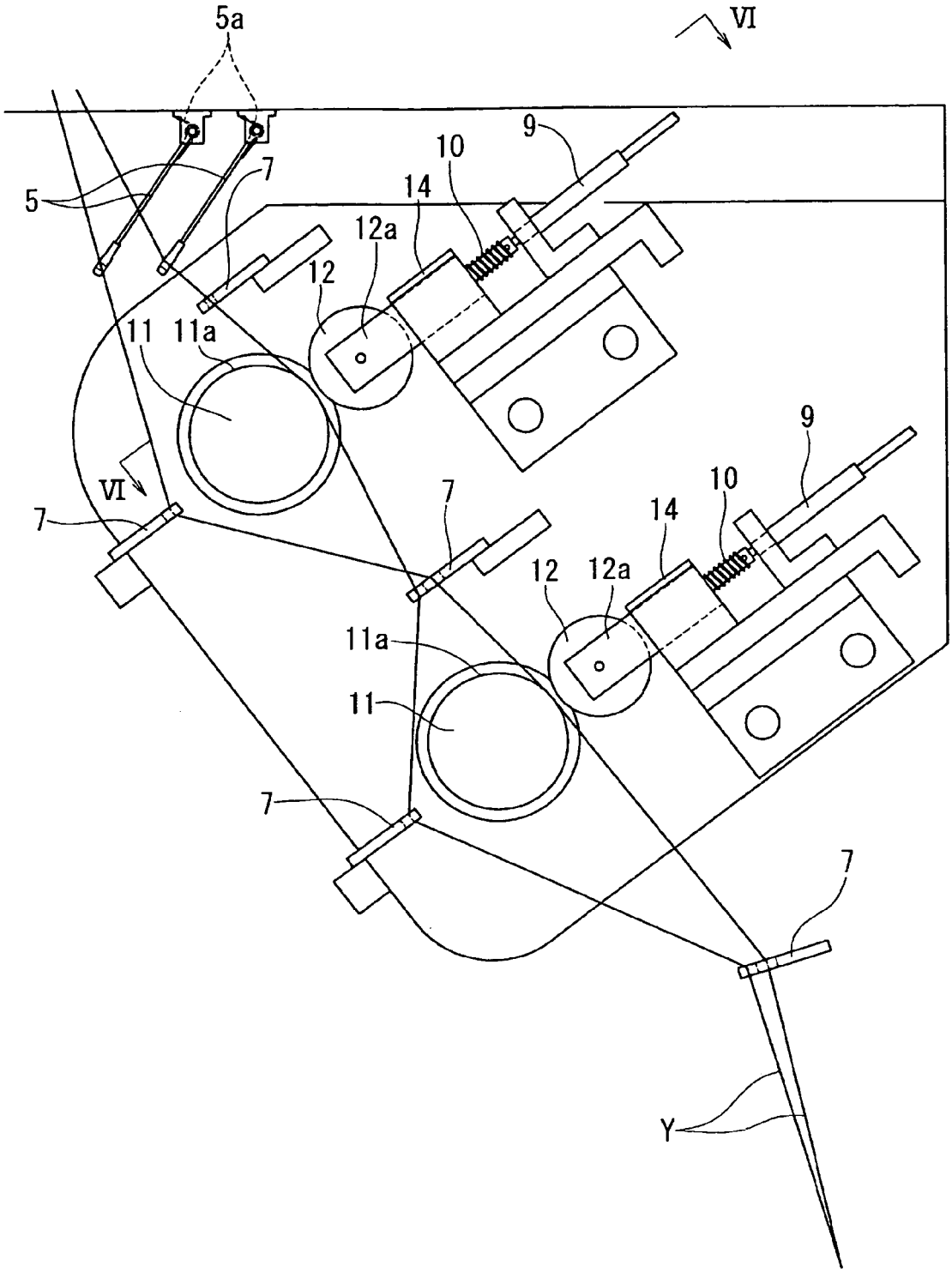
FIG. 5 is a partial enlarged side view of a yarn feeder according to a second embodiment of the present invention.
Figure 6:
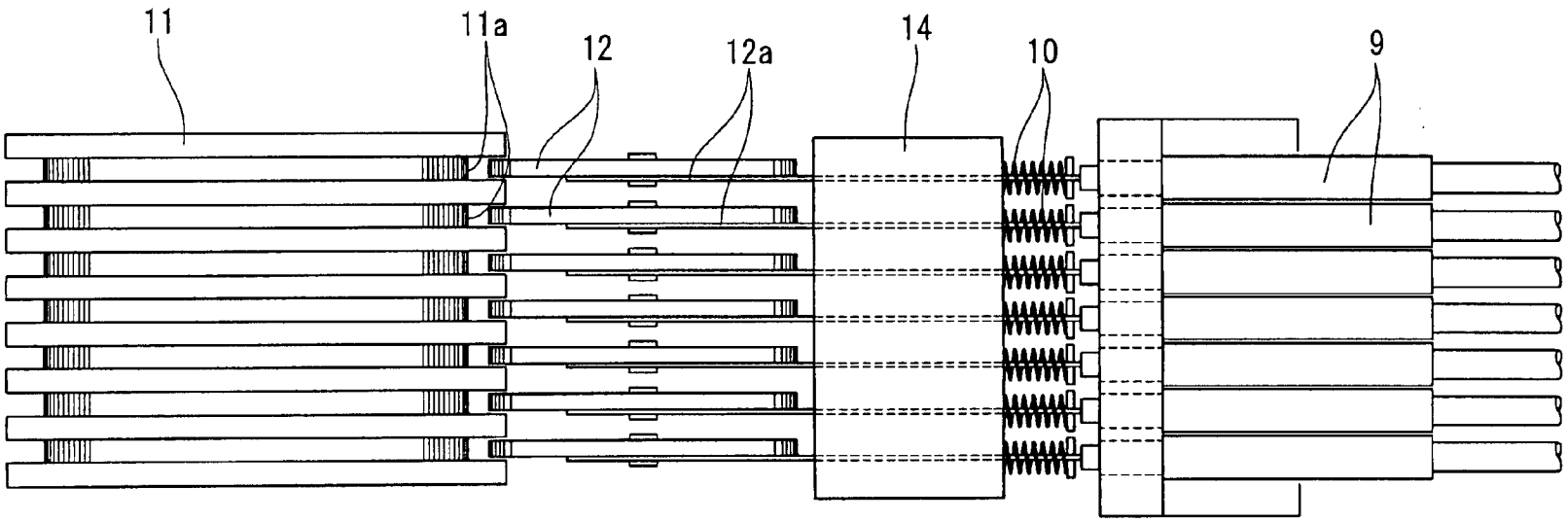
FIG. 6 is an enlarged view of the yarn feeder of FIG. 5, as viewed in the direction of the arrows VI of FIG. 5.

FIGS. 5 and 6 show the second embodiment. The yarn feeder of this embodiment, too, includes a brake means comprising upstream and downstream brake units. Each brake unit includes a roll 11 having a plurality of annular grooves 11*a* formed in the outer periphery thereof at equal intervals in the axial direction of the roll 11, and a plurality of disks 12 each rotatably supported by a support rod 12*a* and adapted to be inserted into the respective annular grooves 11*a*. Like the support rods 4*a* of the first embodiment, the support rods 12*a* are individually coupled to the air cylinders 9 and guided by a guide member 14 so as to be movable toward and away from the respective grooves 11*a*. In exactly the same manner as in the first embodiment, the support rods 12*a* are biased away from the respective grooves 11*a* by compression coil springs 10 mounted around the respective rods 12*a* between the rear end of the guide member 14 and pins fixed to the support rods 12*a*. Alternate yarns are fed to the upstream brake unit and the remaining alternate yarns are fed to the downstream brake units so as to cross each other.

The roll 11 is driven by a servo motor 13. By selectively activating any one of the air cylinders 9, the corresponding disk 12 is pushed into the respective groove 11*a* to press the yarn in this groove 11*a* against the bottom of the groove 11*a*. Thus, as in the first embodiment, braking force can be applied to any desired yarn or yarns. Moreover, in this embodiment, by turning the roll 11 with the servo motor 13 at a variable speed, it is possible to adjust the degree of braking and thus the feed length of the yarn that is being braked by the brake means, thereby infinitely adjusting the heights of piles. As in the first embodiment, the grooves 11*a* have their bottoms satin-finished.

In either embodiment, all of the pile yarns are fed by common feed rolls at the same speed. But instead, yarns may be fed by separate feed rolls at different speeds. The means for keeping yarns tensioned between the brake means and the feed rolls are not limited to the swing arms shown.

What is claimed is:

1. A yarn feeder for a tufting machine having needles aligned in a width direction of a fabric to be formed into a tufted product in the tufting machine, said yarn feeder comprising:

a plurality of yarn feed rolls operable to feed a plurality of rows of pile yarns to respective ones of said needles at a predetermined feed speed; and a brake device operable to individually and selectively apply braking force to the respective pile yarns while the yarns are being fed from said feed rolls to said needles, wherein said brake device comprises a grooved member formed with a plurality of grooves each for receiving one of the pile yarns, and a plurality of presser members which are individually movable toward said respective grooves until pressed against bottoms of said grooves with the pile yarns sandwiched between said presser members and said bottoms of said grooves, and movable away from said bottoms, wherein said grooved member is a grooved roll which can be rotated at a variable speed, wherein said plurality of grooves are annular grooves formed in an outer peripheral surface of said grooved roll, and wherein said plurality of presser members are rotatably supported disks each having its outer edge received in one of said annular grooves so as to be individually pressed against said bottoms of said annular grooves with the pile yarns sandwiched therebetween.

2. A yarn feeder for a tufting machine having needles aligned in a width direction of a fabric to be formed into a tufted product in the tufting machine, said yarn feeder comprising:

a plurality of yarn feed rolls operable to feed a plurality of rows of pile yarns to respective ones of said needles at a predetermined feed speed; and a brake device operable to individually and selectively apply braking force to the respective pile yarns while the yarns are being fed from said feed rolls to said needles, wherein said brake device comprises a plurality of brake units arranged in the feed direction of the pile yarns between said feed rolls and said needles, each of said brake units comprising a grooved member formed with a plurality of grooves each for receiving one of part of the pile yarns that are not fed through the other brake unit, and a plurality of presser members which are individually movable toward said bottoms of said respective grooves until pressed against said bottoms with the pile yarns sandwiched between said presser members and said bottoms of said grooves, and movable away from said bottoms, wherein said grooved members are grooved rolls which can be rotated at a variable speed, wherein said plurality of grooves are annular grooves formed in an outer peripheral surface of said grooved rolls, and wherein said plurality of presser members are rotatably supported disks each having its outer edge received in one of said annular grooves so as to be individually pressed against said bottoms of said annular grooves with the pile yarns sandwiched therebetween.

3. The yarn feeder of claim 1, further comprising a tensioner provided between said yarn feed rolls and said brake device for tensioning any pile yarn to which braking force is being applied by said brake device.

4. The yarn feeder of claim 2, further comprising a tensioner provided between said yarn feed rolls and said brake device for tensioning any pile yarn to which braking force is being applied by said brake device.

* * * * *